US006008740A

United States Patent [19]

Hopkins

[11] Patent Number: 6,008,740

[45] **Date of Patent: *Dec. 28, 1999**

[54] ELECTRONIC SPEED LIMIT NOTIFICATION SYSTEM

[75] Inventor: Thomas L. Hopkins, Mundelein, Ill.

[73] Assignee: STMicroelectronics, Inc., Carrollton, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,446

[22] Filed: Dec. 17, 1997

[51] Int. Cl.[6] ..... G08G 1/09

[52] U.S. Cl. ..... 340/905; 340/903; 340/936; 340/460; 701/117; 455/517

[58] Field of Search ..... 340/439, 438, 340/903, 905, 575, 576, 460, 936; 701/117, 119, 35; 455/517

[56] References Cited

U.S. PATENT DOCUMENTS

| | | | |
|---|---|---|---|
| 3,748,466 | 7/1973 | Sibley et al. | 246/63 C |
| 3,775,743 | 11/1973 | Carter | 340/905 |
| 4,591,823 | 5/1986 | Horvat | 340/905 |
| 4,671,106 | 6/1987 | Schroeder | 73/117.5 |
| 5,452,870 | 9/1995 | Heggestad | 246/182 R |
| 5,493,291 | 2/1996 | Bruggemann | 340/905 |
| 5,554,982 | 9/1996 | Shirkey et al. | 340/903 |
| 5,689,422 | 11/1997 | Heymann et al. | 340/903 |
| 5,786,750 | 7/1998 | Cooper | 340/425.5 |

*Primary Examiner*—Daniel J. Wu

*Attorney, Agent, or Firm*—Michael J. Buchenhorner; Theodore E. Galanthay; Lisa K. Jorgenson

[57] ABSTRACT

An electronic speed limit notification system comprises a transmitter for transmitting speed limit information ("SLI"), and a receiver for receiving said transmitted SLI, wherein said receiver can be physically located in a vehicle. The SLI comprises one or more speed limits, wherein each speed limit is the maximum or minimum legal speed for specific vehicles on a specific segment of a specific road traveling in a specific direction.

42 Claims, 4 Drawing Sheets

ELECTRONIC SPEED LIMIT NOTIFICATION SYSTEM

FIELD OF THE INVENTION

The invention disclosed broadly relates to the field of remote messaging systems and smart highways, and more particularly relates to the field of electronic speed limit notification systems. The invention automatically supplies the driver of a vehicle with the current speed limit. This eliminates the problems of obscured or damaged speed limit signs and of distracted drivers who do not notice a particular sign.

BACKGROUND OF THE INVENTION

Speed limits along any given route may change frequently, particularly in urban settings, as a driver drives through various areas. Moreover, even along a given route speed limits may change at certain times, such as during school hours or "rush-hours." The current and accepted method of informing the driver of the speed limit is to post speed limit signs on the side of the road. This presents a problem if the driver cannot see, or does not notice, one or more of these signs.

The drivers field of vision can be blocked or obscured in a number of ways. Common causes include: (i) larger vehicles or trees, (ii) poor lighting conditions, (iii) damaged, missing, or vandalized signs, and (iv) weather, such as snow, accumulating on signs, on windows, or merely obstructing the view while falling. Additionally, the driver might not be able to look to the side of the road because of busy traffic conditions.

Accordingly, there is a need for a system of communicating speed limits to the driver which overcomes the above problems.

SUMMARY OF THE INVENTION

An electronic speed limit notification system comprises a transmitter for transmitting speed limit information ("SLI"), and a receiver for receiving said transmitted SLI, wherein said receiver can be physically located in a vehicle. The SLI comprises one or more speed limits, wherein each speed limit is the maximum or minimum legal speed for specific vehicles on a specific segment of a specific road traveling in a specific direction.

DESCRIPTION OF THE PREFERRED EMBODIMENT

Figure 1:
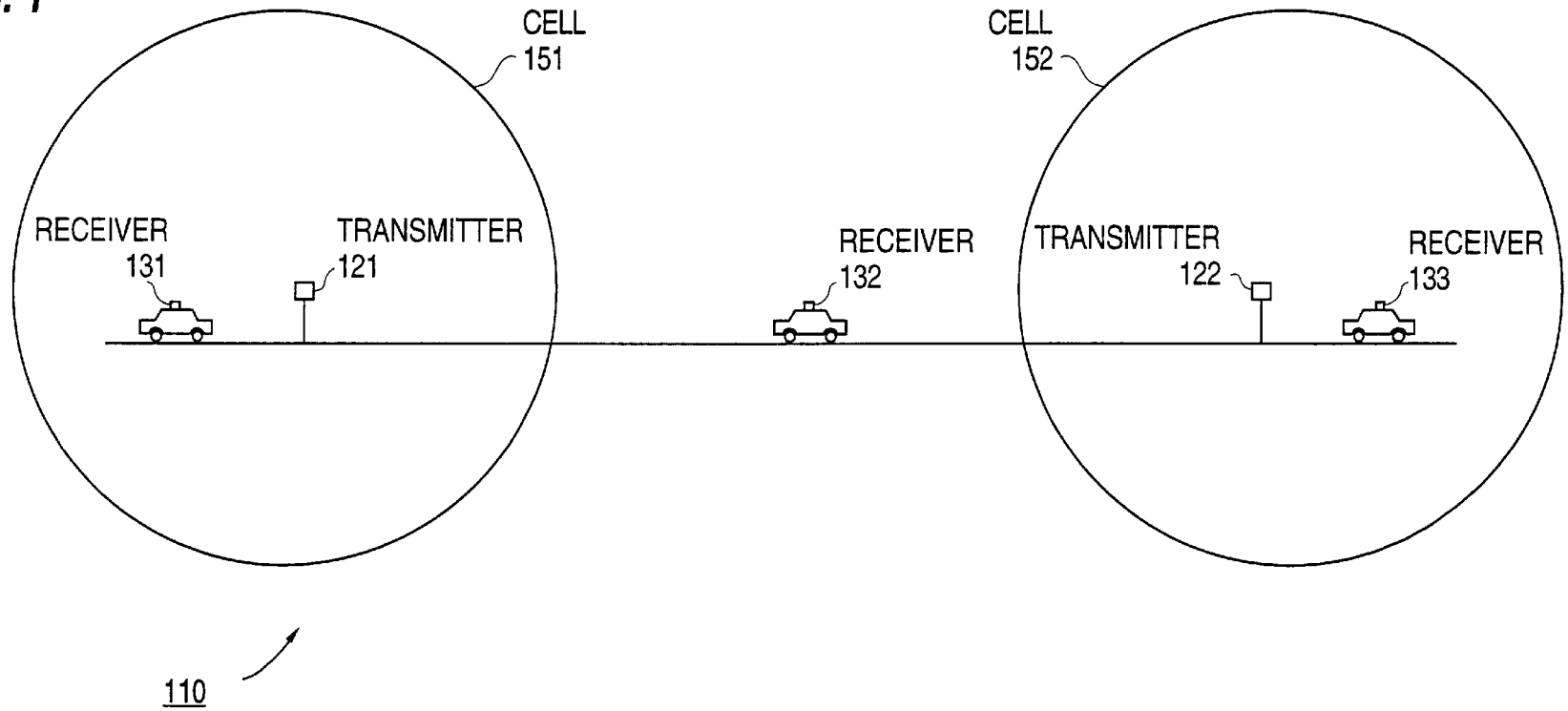
FIG. 1 is an illustration of an Electronic Speed Limit Notification System ("ESLNS") according to the present invention.

Referring to FIG. 1, there is shown an ESLNS (or system) 110 according to the present invention. The system 110 comprises a plurality of transmitters represented by units 121 and 122, for example (collectively referred to as transmitters 120) and a series of receivers 131, 132, and 133 (collectively referred to as receivers 130), where each receiver 130 is located in a vehicle. In accordance with the invention, each transmitter 120 transmits a signal indicative of a speed limit for its corresponding area. The vehicle housed receivers 130, are tuned to receive speed limit information from the transmitters 120. In this embodiment, the transmitters 120 are located alongside the road, and can be attached to existing speed limit signs. As with speed limit signs, transmitters 120 would be needed wherever the speed limit changed, either decreasing or increasing, and wherever new traffic entered the road. The system 110 also comprises cells 151 and 152 representing the coverage regions for transmitters 121 and 122, respectively. Thus, the mobile receivers 131 and 133 have the capability for determining the applicable speed limits for each vehicle without the need of viewing roadside signs.

In an alternate embodiment, the transmitters can be mounted on buildings or in some other stationary manner. There need not necessarily be more than one transmitter for a given area, however a central transmitter embodiment would necessitate the transmitter transmitting speed limits for all of the roads covered by the system. Further, such a central tranmsitter need not even be stationary as long as its transmission always reaches the entire area covered by the ESLNS 110.

Preferably, the transmitters 120 are low-power and all operate on the same frequency. Because the transmitted power attenuates with increasing distance from the transmitters 120, interference is avoided by spacing the transmitters 120 far enough apart, and using low enough power, so that any receiver 130 only receives the transmission from one transmitter 120 at a time. In the system of FIG. 1, the receiver 130 moves from one transmitter "cell" 151–152 to another, and never has an interference problem.

Additionally, the ESLNS 110 has another safeguard against interference. The transmitters 120 use frequency modulation ("FM") transmission. Because an FM receiver will lock on to the strongest signal, the receiver 130 will be able to receive the proper transmission as long as it has more power than any interfering signal.

Figure 2:
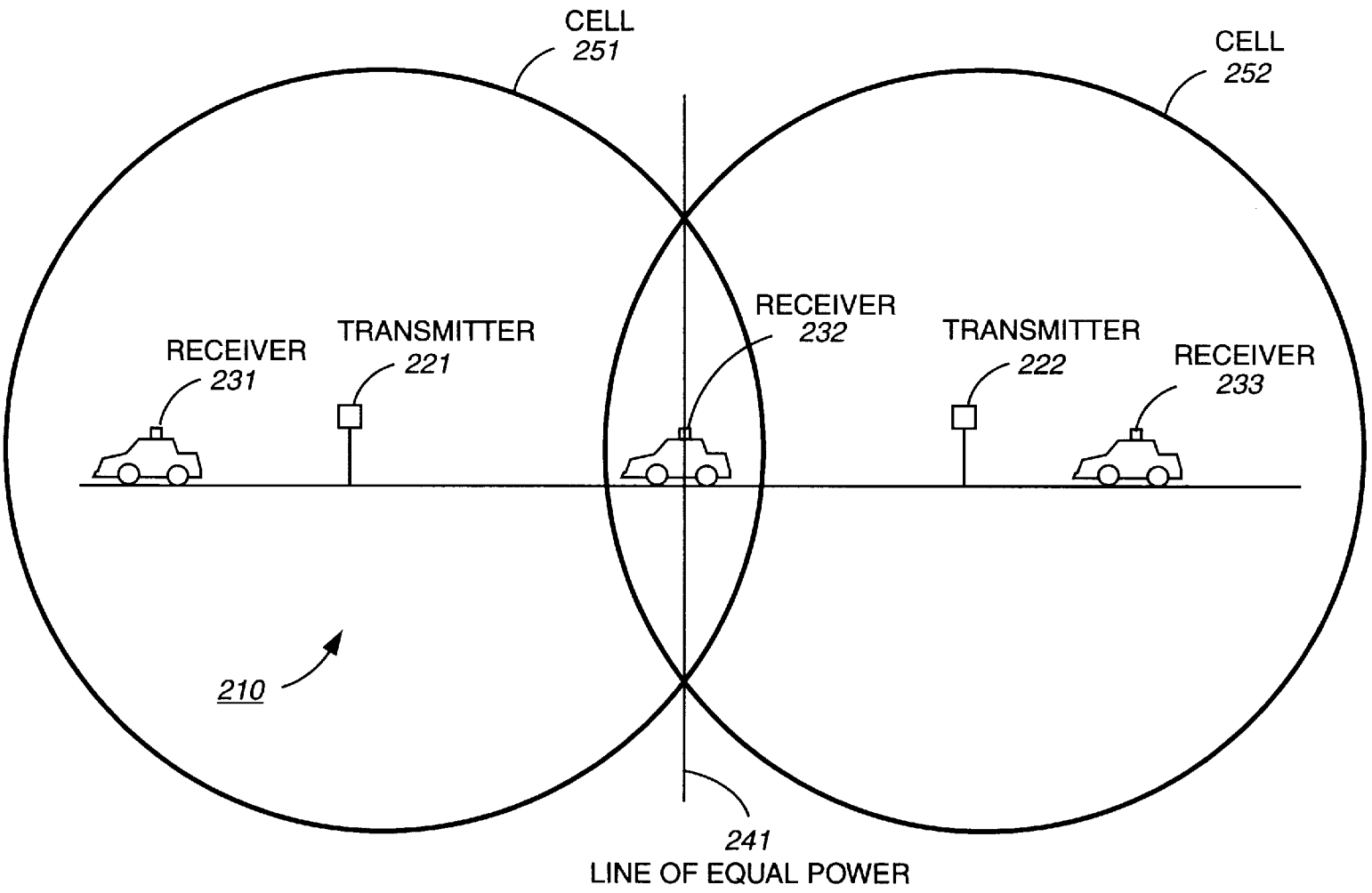
FIG. 2 is an illustration of an alternate embodiment of an ESLNS with overlapping cells.

Referring to FIG. 2, in an alternate embodiment, the transmitter cells 251–252 may overlap. In such a case, a receiver 232 could receive signals from two transmitters 221–222 at the same time. The use of FM transmission will protect this system 210 against such interference, except possibly perhaps near points along the line 241 in the cell overlap where both transmissions have equal strength. At these points, the receiver 232 will need to employ some means, such as a code for error detection and correction, to detect the interference and to ignore the data received.

Referring again to FIG. 1, the transmitters 120 broadcast the speed limit and associated data using conventional techniques like frequency-shift keying ("FSK") of binary coded data. In alternate embodiments, the transmitters 120 may utilize other means for modulating the data, such as phase-shift keying or amplitude modulation.

The data that the transmitters 120 broadcast are grouped into a "word," and consist of: (1) speed limit, either maximum or minimum, in km/hr, (2) direction of travel, in degrees ("DOT"), (3) vehicle class, and (4) road designator. The speed limit is the number that would otherwise appear on the roadside sign. The DOT is the degrees from magnetic north for which the speed limit applies. By having a DOT field, a transmitter 120 may broadcast, for example, different speed limits for each DOT on a two-way road or at an intersection. The vehicle class category recognizes that there are often different speed maximums or minimums for different types of vehicles. The following codes can be used:

| | |
|---|---|
| 0 = All Class Max. | 1 = All Class Min. |
| 2 = Automobile Max. | 3 = Automobile Min. |
| 4 = Truck Max. | 5 = Truck Min. |
| 6 = Automobile + Trailer Max. | 7 = Automobile + Trailer Min. |

The road designator is merely the name of the road or the number of the highway, etc., and is available to be displayed to the driver. However, it cannot be used by the receiver to determine if the speed limit applies to a particular vehicle, unless the receiver knows what road it is on. A sample word is 08809021070, which is parsed as follows:

088: speed limit is 88 km/hr, or 55 miles per hour ("mph"),

090: speed limit applies to the eastbound traffic,

2: speed limit applies to automobiles, and is a max. speed limit,

1070: speed limit applies to Interstate 70.

Figure 3:
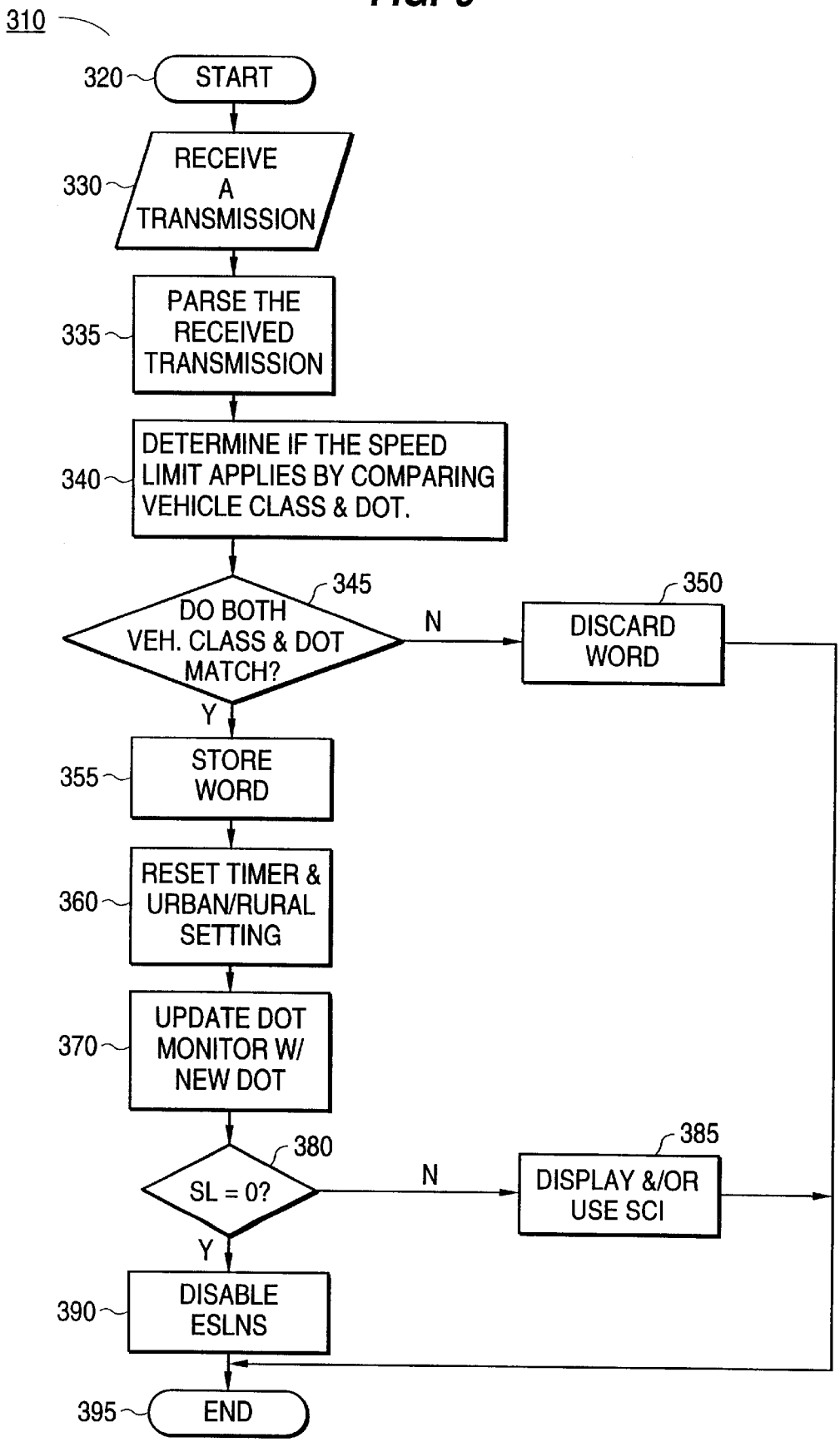
FIG. 3 is a flow diagram for the receiving of a transmission in an ESLNS according to the present invention.

Referring to FIG. 3, there is shown a method 310 for receiving a transmission in accordance with the invention. The preceding discussion described the first three steps 320–335 for the receiver. After receiving an interrupt indicating that a transmission has arrived and jumping to the beginning of the routine 320, the receiver receives the transmission 330, and then parses it 335.

In an alternate embodiment, a word could comprise additional fields for multiple speed limits and vehicle classes, etc. Additionally, virtually any data could be transmitted to the receiver either for use by the receiver or merely for availability to the driver. Such data may include information regarding temporarily lowered speed limits, road hazard information, traffic reports, construction reports, weather reports, maps or position information, messages from home, etc. Additionally, the fields allocated to these, or any other, messages can be of variable or fixed length. Each receiver could also have a unique identifier and the ESLNS could operate as a packet-oriented messaging system. Moreover, the receiver might also be connected to a variety of onboard devices, in addition to the onboard magnetic compass, from which the receiver could receive information. These onboard devices could include a fuel efficiency computer, a map system, a Global Positioning System receiver, a speedometer, or an odometer. In embodiments containing such devices, the system would be able to determine what road it is currently on, how far it has traveled since the last update, or other information or statistics, as well as possibly displaying the information and statistics.

Referring again to FIG. 3, after receiving a word and parsing out the different fields, the receiver determines whether of not the speed limit applies to its vehicle 340. This step requires two comparisons.

In the first, the receiver compares the vehicle class field with the class of its host vehicle. Note that the receiver will need to be loaded in advance with the particular class or classes that apply to its host vehicle. In the second comparison, the receiver compares the DOT with its own direction, which the receiver derives from the vehicle's magnetic compass. To be considered a match, these two directions must be within plus or minus 10 degrees, however, other thresholds are, of course, possible.

A decision is then made as to whether both the vehicle class and the DOT match 345. The receiver either stores the word 355, or discards it 350. If the receiver discards the word 350, then the receiver jumps to the end of the routine 395. If the word is stored 355, then the receiver continues its processing by resetting the timer and urban/rural setting 360, and the DOT monitor 370, as explained below.

The receiver's next task is to check the value of the speed limit 380. If it is non-zero, the receiver may 385: (1) display it to the driver, (2) use it to decrease the speed setting on the cruise control if the vehicle's speed is greater than the max. speed limit, or (3) use it to sound a warning tone if the vehicle's speed is greater than the max. speed limit. If the speed limit is zero, the receiver recognizes it as a disable code, as explained below, and disables the ESLNS 390. Note that, due to safety concerns, the receiver should not increase the speed setting on the cruise control.

Referring again to FIG. 3, once the word is stored 355, the receiver will keep the stored word until (1) it finds another match and updates the stored word 330–355, or (2) it determines that the stored speed limit is no longer applicable. If the receiver determines that the stored speed limit is no longer applicable, the receiver will ignore this stored speed limit and wait for another transmission. This process of ignoring and waiting is referred to as disabling the ESLNS 390.

Figure 4:
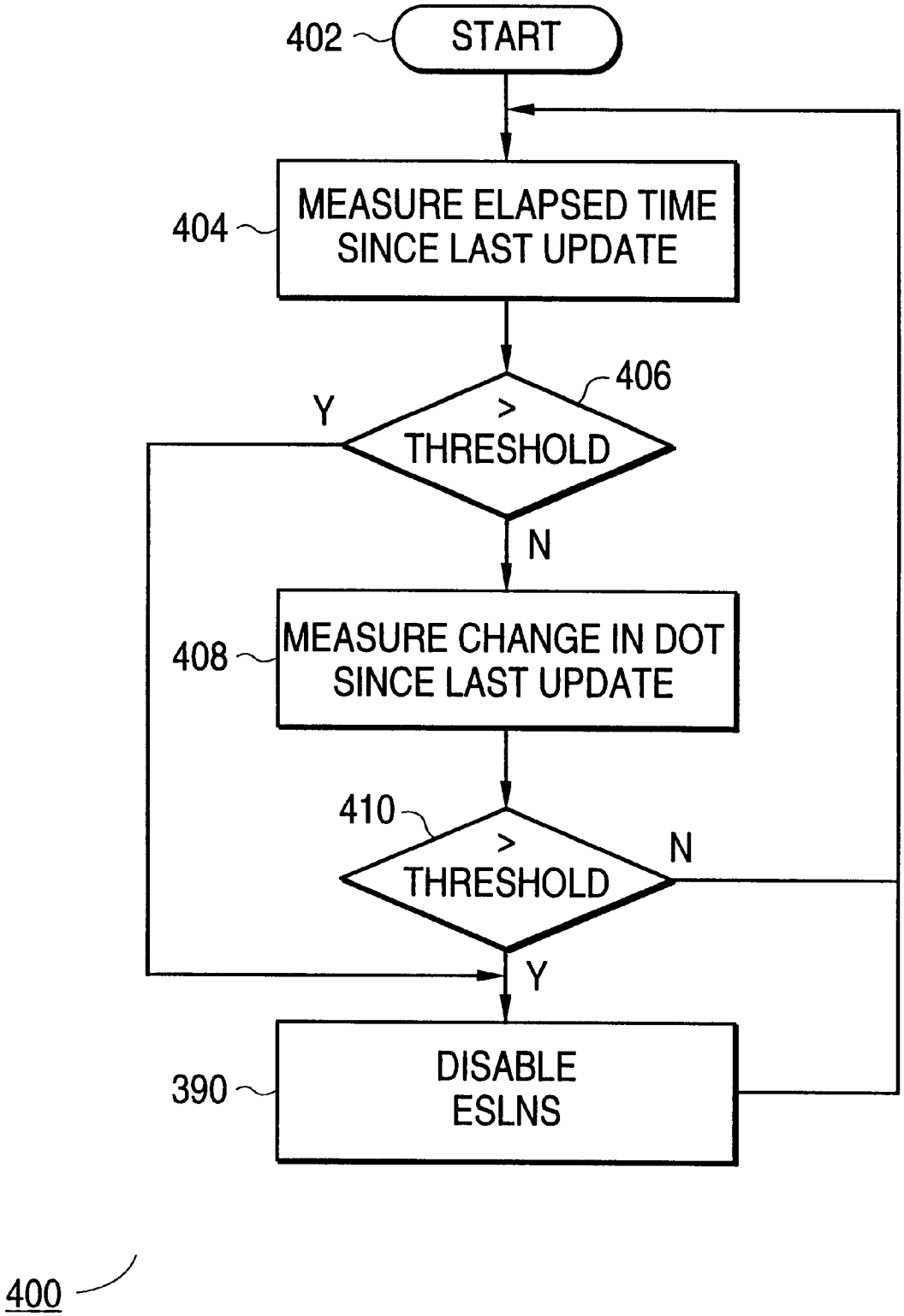
FIG. 4 is a flow diagram for a wait loop in an ESLNS according to the present invention.

Referring to the wait loop 400 in FIG. 4, the receiver can decide that the stored speed limit is no longer applicable in one of three ways: (1) the vehicle's current direction of travel changes by more than 30 degrees from its direction of travel at the last update 408–410, (2) no update has been received 404–406 for either (i) 5 minutes in an urban area, where an urban area is defined as an area with a speed limit of 45 mph or lower, or (ii) 30 minutes in a rural area, where a rural area is defined as an area with a speed limit of over 45 mph and is presumably a highway, or (3) a disable code is received, as shown in FIG. 3, step 380. The disable code is defined as a speed limit of zero for a particular direction for all classes of vehicles, however, other definitions are, of course, possible. The use of a disable code allows the ESLNS to be disabled at the end of an area equipped with the system.

In both the elapsed time and the DOT disable methods, discussed above, the ESLNS needs to ensure that no interrupt for receiving a transmission is acted on between the time that the calculation is made (i.e. the calculation of either the elapsed time or the change in the DOT) and the time that the disable routine is executed. If, for example, the system was interrupted after it had decided that the elapsed time was greater than the threshold 406, but before it went on to disable the system 390, then when the ESLNS returned from receiving the new word, it would immediately discard it when it entered the disable routine 390. Note, that this problem could be solved in other ways, but it must be dealt with.

In an alternate embodiment, the ESLNS could compute the difference in DOT between the vehicle's current DOT and the DOT contained in the last update, rather than between the vehicle's current DOT and the vehicle's DOT when the last update was received. In another alternate embodiment, the ESLNS could keep track of the elapsed distance since the last update, and when the elapsed distance reaches a given threshold, the system could automatically disable itself. In such an embodiment, the system would need to reset the distance monitor whenever a valid update was received.

In alternate embodiments, different means for disabling the ESLNS are possible. These may involve using different values for the lengths of time, the angles of direction change, the speed limit thresholds for the timer settings, etc. The different means may also involve totally different concepts in disabling. As an example, the ESLNS may simply display a running timer that shows the driver the time since the last update and let the driver decide if the data is still valid.

Alternatively, in a system utilizing a central transmitter, the receiver may be responsible for parsing out its appropriate speed limit utilizing a road map system to tell it where it is. In a such a case, the receiver may immediately assume a disable mode if there is no speed limit for its location.

Although a specific embodiment of the invention has been disclosed, it will be understood by those having skill in the art that changes can be made to this specific embodiment without departing from the spirit and scope of the invention. The scope of the invention is not to be restricted, therefore, to the specific embodiment, and it is intended that the appended claims cover any and all such applications, modifications, and embodiments within the scope of the present invention.

What is claimed is:

1. An electronic speed limit notification system comprising:

at least one transmitter for transmitting speed limit information ("SLI"), said SLI comprising:

at least one speed limit, wherein said speed limit is the maximum or minimum legal speed for specific vehicles on a specific segment of a specific route traveling in a specific direction; and route designator information for each speed limit of the SLI, the route designator information indicating the specific route to which the speed limit applies.

2. The system of claim 1 further comprising at least one receiver for use in a vehicle and adapted to receive the SLI transmitted by at least one transmitter.

3. The system of claim 1 wherein the system comprises more than one transmitter and wherein each transmitter is located at a location apart from other transmitters for transmitting SLI relevant to the location.

4. The system of claim 1 wherein the transmitter further comprises means for transmitting data indicating a plurality of speed limits.

5. The system of claim 1 wherein the transmitter further comprises means for transmitting data indicating to which segment of the route each speed limit applies.

6. The system of claim 1 wherein the transmitter further comprises means for transmitting data indicating the direction of travel ("DOT") to which each speed limit applies.

7. The system of claim 1 wherein the transmitter further comprises means for transmitting data selected from the group consisting of road hazard information, traffic reports, construction reports, weather reports, and E-Mail-type messages.

8. The system of claim 1 wherein the transmitter is a self-powered transmitter that transmits the SLI continuously or at predetermined intervals.

9. The system of claim 1 wherein the transmitter is a multidirectional transmitter.

10. The system of claim 1 wherein the transmitter also transmits driving conditions data that changes over time.

11. In an electronic speed limit notification system comprising at least one transmitter for transmitting speed limit information ("SLI"), a receiver for receiving transmitted SLI for use in a vehicle, said receiver comprising means for presenting at least part of said SLI to a person controlling said vehicle, said SLI comprising:

at least one speed limit, wherein said speed limit is the maximum or minimum legal speed for specific vehicles on a specific segment of a specific route traveling in a specific direction; and route designator information for each speed limit of the SLI, the route designator information indicating the specific route to which the speed limit applies.

12. The receiver of claim 11 further comprising:

a speaker, said speaker for use by said system: (i) as an alarm when the vehicle is over the speed limit, and (ii) to audibly convey a representation of the information received or computed.

13. The receiver of claim 11 further comprising a display, said display for visibly conveying a representation of any of the information received.

14. The receiver of claim 11 further comprising an alarm for indicating when the vehicle is over the received speed limit.

15. The receiver of claim 11 further comprising means for interfacing with an odometer.

16. The receiver of claim 11 further comprising means for interfacing with a speedometer.

17. The receiver of claim 11 wherein said receiver further comprises a means for receiving data from an onboard information device selected from the group consisting of an onboard fuel efficiency computer, an onboard map system, and an onboard Global Positioning System receiver.

18. The receiver of claim 11 further comprising:

means for controlling a cruise control system, or an equivalent device, utilizing the speed limit information.

19. The receiver of claim 11 further comprising:

means for determining from said SLI whether or not a given speed limit applies to said receiver, said means comprising an algorithm that utilizes: (i) a vehicle class indicator, and (ii) a DOT indicator together with DOT information supplied by an onboard compass.

20. The receiver of claim 11 further comprising a means for deciding whether or not an applicable speed limit remains valid by comparing the vehicle's current DOT with a given baseline and if the difference exceeds a given threshold, declaring the speed limit no longer valid.

21. The receiver of claim 11 wherein the receiver comprises means for receiving information from a self-powered transmitter that transmits the SLI continuously or at predetermined intervals.

22. The receiver of claim 11 wherein the receiver comprises means for receiving information from a multidirectional transmitter that transmits the SLI.

23. The receiver of claim 11 wherein the receiver comprises means for receiving driving conditions data that changes over time.

24. The receiver of claim 11 wherein said receiver comprises means for receiving data from an onboard fuel efficiency computer.

25. The receiver of claim 11 wherein said receiver comprises means for receiving data indicating a plurality of speed limits.

26. The receiver of claim 25 wherein said receiver comprises means for receiving data indicating to which segment of the route each speed limit applies.

27. The receiver of claim 25 wherein said receiver comprises means for receiving data indicating the direction of travel ("DOT") to which each speed limit applies.

28. The receiver of claim 25 wherein said receiver comprises means for receiving road information data selected from the group consisting of road hazard information, traffic reports, construction reports, weather reports, and E-Mail-type messages.

29. An electronic speed limit notification method comprising: transmitting speed limit information ("SLI"), said SLI comprising:

one or more speed limits, wherein said speed limit is the maximum or minimum legal speed for specific vehicles on a specific segment of a specific road traveling in a specific direction; and road designator information for each speed limit of the SLI, the road designator information indicating the specific road to which the speed limit applies.

30. The electronic speed limit notification method of claim 29 further comprising receiving, in a vehicle, said transmitted SLI.

31. The method of claim 30 further comprising:

receiving data indicating a plurality of speed limits;

receiving data, for each speed limit, indicating which road and DOT and vehicles the speed limit applies to, said data comprising a road designator, a DOT identifier, and a vehicle class identifier; and receiving road information data selected from the group consisting of road hazard information, traffic reports, construction reports, weather reports, and E-Mail-type messages.

32. The method of claim 30 wherein said receiving further comprises receiving data from an onboard information device selected from the group consisting of an onboard fuel efficiency computer, an onboard map system, and an onboard Global Positioning System receiver.

33. The method of claim 30 further comprising controlling a cruise control system, or an equivalent device, utilizing the speed limit information.

34. The method of claim 30 further comprising comparing the vehicle's current DOT with a given baseline and if the difference exceeds a given threshold, deciding that an applicable speed limit no longer remains valid.

35. The method of claim 30 wherein said transmitting further comprises transmitting from a self-powered transmitter that transmits the SLI continuously or at predetermined intervals.

36. The method of claim 30 wherein said transmitting further comprises transmitting from a multidirectional transmitter.

37. The method of claim 30 further comprising transmitting driving conditions data that changes over time.

38. The method of claim 30 further comprising receiving data from an onboard fuel efficiency computer.

39. The method of claim 30 further comprising determining from said SLI whether or not a received speed limit applies to the receiving vehicle.

40. The method of claim 39 further comprising using an algorithm that utilizes: (i) a vehicle class indicator, and (ii) a DOT indicator together with DOT information supplied by an onboard compass.

41. In an electronic speed limit notification system comprising at least one transmitter for transmitting speed limit information ("SLI"), said SLI comprising at least one speed limit, wherein said speed limit is the maximum or minimum legal speed for specific vehicles on a specific segment of a specific route traveling in a specific direction, a receiver for receiving transmitted SLI for use in a vehicle, said receiver comprising means for presenting said SLI to a person controlling said vehicle.

42. An electronic speed limit notification method comprising:

transmitting speed limit information ("SLI"), said SLI comprising one or more speed limits, wherein said speed limit is the maximum or minimum legal speed for specific vehicles on a specific segment of a specific road traveling in a specific direction;

receiving, in a vehicle, transmitted speed limit information ("SLI"), said SLI comprising one or more speed limits, wherein said speed limit is the maximum or minimum legal speed for specific vehicles on a specific segment of a specific road traveling in a specific direction; and deciding whether or not an applicable speed limit remains valid, wherein said step of deciding comprises using an algorithm that (i) measures the change in the vehicle's DOT since the last update or the difference between the vehicle's current DOT and the DOT field of the last update, (ii) measures the elapsed time since the last update, possibly using different time thresholds for different speed limits or types of roads or types of areas, (iii) measures the elapsed distance since the last update, possibly using different distance thresholds for different speed limits or types of roads or types of areas, and (iv) recognizes a disable code, said code possibly being a speed limit of zero for a given road and DOT and vehicle class.

* * * * *